US008660465B2

(12) United States Patent
Kim et al.

(10) Patent No.: US 8,660,465 B2
(45) Date of Patent: Feb. 25, 2014

(54) SURFACE-PATTERNED PHOTORECEPTOR

(75) Inventors: Woo Soo Kim, Oakville (CA); Nan-Xing Hu, Oakville (CA); Cuong Vong, Hamilton (CA); Yvan Gagnon, Mississauga (CA); Vladislav Skorokhod, Mississauga (CA)

(73) Assignee: Xerox Corporation, Norwalk, CT (US)

( * ) Notice: Subject to any disclaimer, the term of this patent is extended or adjusted under 35 U.S.C. 154(b) by 324 days.

(21) Appl. No.: 12/911,643

(22) Filed: Oct. 25, 2010

(65) Prior Publication Data

US 2012/0099897 A1 Apr. 26, 2012

(51) Int. Cl.
*G03G 21/10* (2006.01)

(52) U.S. Cl.
USPC ..... 399/159; 430/56; 430/58.7; 430/119.82; 430/119.84; 399/350

(58) Field of Classification Search
USPC ..... 399/159, 350; 430/58.7, 56, 119.82, 430/119.84
See application file for complete search history.

(56) References Cited

U.S. PATENT DOCUMENTS

| | | | | |
|---|---|---|---|---|
| 3,121,006 | A | 2/1964 | Middleton et al. | |
| 4,076,564 | A * | 2/1978 | Fisher | 216/52 |
| 4,286,033 | A | 8/1981 | Neyhart et al. | |
| 4,291,110 | A | 9/1981 | Lee | |
| 4,338,387 | A | 7/1982 | Hewitt | |
| 4,387,980 | A | 6/1983 | Ueno et al. | |
| 4,464,450 | A | 8/1984 | Teuscher | |
| 4,587,189 | A | 5/1986 | Hor et al. | |
| 4,664,995 | A | 5/1987 | Horgan et al. | |
| 4,921,773 | A | 5/1990 | Melnyk et al. | |
| 5,069,993 | A | 12/1991 | Robinette et al. | |
| 5,117,264 | A * | 5/1992 | Frankel et al. | 399/350 |
| 5,756,245 | A | 5/1998 | Esteghamatian et al. | |
| 7,645,547 | B2 * | 1/2010 | Okuda et al. | 430/56 |
| 7,718,331 | B2 * | 5/2010 | Uematsu et al. | 430/56 |
| 8,227,166 | B2 * | 7/2012 | Kim et al. | 430/131 |
| 2008/0026308 | A1 * | 1/2008 | Qi et al. | 430/58.4 |
| 2010/0172670 | A1 * | 7/2010 | Ohshima et al. | 430/58.05 |

FOREIGN PATENT DOCUMENTS

JP 2001066814 A * 3/2001 ..... G03G 5/147

OTHER PUBLICATIONS

English language machine translation of JP 2001-066814 (Mar. 2001).*

Borsenberger, Paul M and Davis Weiss. Organic Photoreceptor for Imaging Systems. New York Marcel-Dekker, Inc. (1993) pp. 6-17.*

U.S. Appl. No. 12/506,175, filed Jul. 20, 2009, Woo Soo Kim et al.

U.S. Appl. No. 12/506,194, filed Jul. 20, 2009, Woo Soo Kim et al.

* cited by examiner

*Primary Examiner* — Christopher Rodee

(74) *Attorney, Agent, or Firm* — Pillsbury Winthrop Shaw Pittman LLP

(57) ABSTRACT

Presently disclosed embodiments relate generally to layers that are useful in imaging apparatus members and components, for use in electrophotographic, including digital, apparatuses. More particularly, the embodiments pertain to an electrophotographic imaging member having its outer surface patterned such that friction with the cleaning blade is significantly reduced.

22 Claims, 4 Drawing Sheets

SURFACE-PATTERNED PHOTORECEPTOR

BACKGROUND

The presently disclosed embodiments relate generally to layers that are useful in imaging apparatus members and components, for use in electrophotographic, including digital, apparatuses. More particularly, the embodiments pertain to an electrophotographic imaging member having its outer surface patterned such that friction with the cleaning blade is significantly reduced.

In electrophotographic printing, the charge retentive surface, typically known as a photoreceptor, is electrostatically charged, and then exposed to a light pattern of an original image to selectively discharge the surface in accordance therewith. The resulting pattern of charged and discharged areas on the photoreceptor form an electrostatic charge pattern, known as a latent image, conforming to the original image. The latent image is developed by contacting it with a finely divided electrostatically attractable powder known as toner. Toner is held on the image areas by the electrostatic charge on the photoreceptor surface. Thus, a toner image is produced in conformity with a light image of the original being reproduced or printed. The toner image may then be transferred to a substrate or support member (e.g., paper) directly or through the use of an intermediate transfer member, and the image affixed thereto to form a permanent record of the image to be reproduced or printed. Subsequent to development, excess toner left on the charge retentive surface is cleaned from the surface. The process is useful for light lens copying from an original or printing electronically generated or stored originals such as with a raster output scanner (ROS), where a charged surface may be imagewise discharged in a variety of ways.

The described electrophotographic process is well known and is commonly used for light lens copying of an original document. Analogous processes also exist in other electrophotographic printing applications such as, for example, digital laser printing and reproduction where charge is deposited on a charge retentive surface in response to electronically generated or stored images.

To charge the surface of a photoreceptor, a scorotron charging device or a contact type charging device has been used. The contact type charging device includes a conductive member which is supplied a voltage from a power source with a D.C. voltage superimposed with a A.C. voltage of no less than twice the level of the D.C. voltage. The charging device contacts the image bearing member (photoreceptor) surface, which is a member to be charged. The outer surface of the image bearing member is charged with the rubbing friction at the contact area. The contact type charging device charges the image bearing member to a predetermined potential. Typically the contact type charger is in the form of a roll charger such as that disclosed in U.S. Pat. No. 4,387,980, the relative portions thereof incorporated herein by reference.

Multilayered photoreceptors or imaging members have at least two layers, and may include a substrate, a conductive layer, an optional undercoat layer (sometimes referred to as a "charge blocking layer" or "hole blocking layer"), an optional adhesive layer, a photogenerating layer (sometimes referred to as a "charge generation layer," "charge generating layer," or "charge generator layer"), a charge transport layer, and an optional overcoating layer in either a flexible belt form or a rigid drum configuration. In the multilayer configuration, the active layers of the photoreceptor are the charge generation layer (CGL) and the charge transport layer (CTL). Enhancement of charge transport across these layers provides better photoreceptor performance. Multilayered flexible photoreceptor members may include an anti-curl layer on the backside of the substrate, opposite to the side of the electrically active layers, to render the desired photoreceptor flatness.

Cleaning blades are used to clean excess toner from the photoreceptor after an electrophotographic cycle complete, and deposit the toner into a waste reservoir. Cleaning blades are typically made of an elastic polymer material, such as polyurethane. Blade cleaning is an important part of printing and impacts the cost, size, power intake and simplicity of the overall imaging system. As such, print defects due to cleaning failure are one of the main issues in xerographic sub-systems. Such defects are typically observed when a low wear overcoated photoreceptor is used. For example, the defects often occur at a very early stage and can be seen in blade chipping due to high friction and poor interactions between the cleaning blade and the photoreceptor which adversely impacts print quality. Thus, there is a need for an improved imaging layer that achieves extended service lifetime and does not suffer from the above-described problems.

The term "photoreceptor" or "photoconductor" is generally used interchangeably with the terms "imaging member." The term "electrophotographic" includes "electrostatographic" and "xerographic." The terms "charge transport molecule" are generally used interchangeably with the terms "hole transport molecule."

SUMMARY

In one embodiment, there is provided an image forming apparatus comprising an imaging member having a surface pattern on an outer layer of the imaging member, wherein the surface pattern comprises an array of periodically ordered indentations or protrusions and further wherein each indentation or protrusion has a depth of or height of less than 3 micrometers; a charging unit that applies electrostatic charge on the imaging member; a developing unit that develops toner image onto the imaging member; a transfer unit that transfers the toner image from the imaging member to a media; and a cleaning unit that cleans the imaging member, wherein the cleaning unit comprises an elastic blade-type cleaner with one of its edge in contact with the imaging member, such that the contact edge deforms at a micro-scale level to complement the surface pattern of the imaging member. In specific embodiments, the image forming apparatus is a color printer comprising four or more imaging members.

In another embodiment, there is provided an image forming apparatus comprising an imaging member further comprising a substrate, a photosensitive layer disposed over the substrate, and an overcoat layer disposed over the photosensitive layer, wherein the overcoat layer has a surface pattern comprising an array of periodically ordered indentations or protrusions and further wherein each indentation or protrusion has a depth of or height of less than 3 micrometers; a charging unit that applies electrostatic charge on the imaging member; a developing unit that develops toner image onto the imaging member; a transfer unit that transfers the toner image from the imaging member to a media, and a cleaning unit that cleans the imaging member, wherein the cleaning unit comprises an elastic cleaning blade with one of its edge in contact with the imaging member, such that the contact edge deforms at a micro-scale level to complement the surface pattern of the imaging member.

In yet another embodiment, there is provided an image forming apparatus comprising an imaging member further comprising a substrate, a photosensitive layer disposed over the substrate, and an overcoat layer disposed over the photosensitive layer, wherein the overcoat layer has a surface pattern comprising an array of periodically ordered indentations or protrusions and each indentation or protrusion has a depth of or height of less than 3 micrometers and further wherein the overcoat layer comprises a crosslinked composition of a tertiary arylamine charge transport component having a general formula of

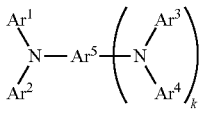

wherein $Ar^1$, $Ar^2$, $Ar^3$, and $Ar^4$ each independently represents an aryl group having about 6 to about 30 carbon atoms, $Ar^5$ represents aromatic hydrocarbon group having about 6 to about 30 carbon atoms, and k represents 0 or 1, and wherein at least one of $Ar^1$, $Ar^2$, $Ar^3$ $Ar^4$, and $Ar^5$ comprises a substituent selected from the group consisting of hydroxyl (—OH), a hydroxymethyl (—$CH_2OH$), an alkoxymethyl (—$CH_2OR$, wherein R is an alkyl having 1 to about 10 carbons), a hydroxylalkyl having 1 to about 10 carbons, and mixtures thereof; a charging unit that applies electrostatic charge on the imaging member; a developing unit that develops toner image onto the imaging member; a transfer unit that transfers the toner image from the imaging member to a media; and a cleaning unit that cleans the imaging member, wherein the cleaning unit comprises an elastic cleaning blade with one of its edge in contact with the imaging member, such that the contact edge deforms at a micro-scale level to complement the surface pattern of the imaging member.

BRIEF DESCRIPTION OF THE DRAWINGS

For a better understanding, reference may be made to the accompanying figures.

DETAILED DESCRIPTION

Figure 1:
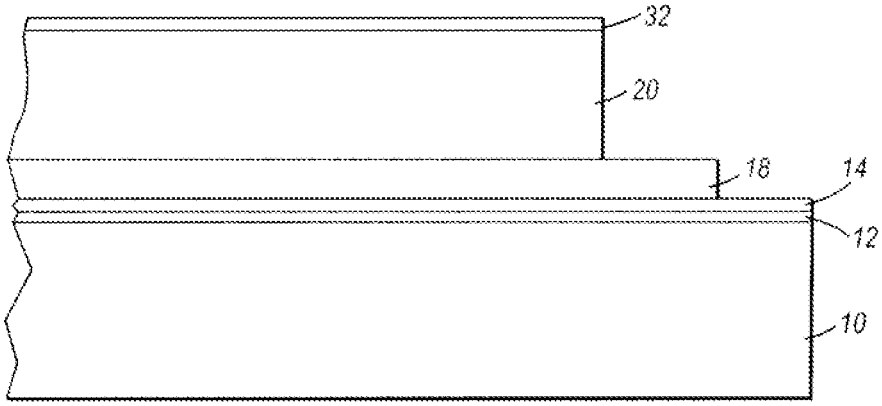
FIG. 1 is a cross-sectional view of an imaging member in a drum configuration according to the present embodiments.

In the following description, reference is made to the accompanying drawings, which form a part hereof and which illustrate several embodiments. It is understood that other embodiments may be used and structural and operational changes may be made without departure from the scope of the present disclosure.

The presently disclosed embodiments are directed generally to an improved electrophotographic imaging member comprising an outer layer having a nano- to micron-scale pattern imprinted into its surface to lower friction with the cleaning blade and improve print quality and performance. The embodiments also pertain to methods for making the improved electrophotographic imaging member.

The exemplary embodiments of this disclosure are described below with reference to the drawings. The specific terms are used in the following description for clarity, selected for illustration in the drawings and not to define or limit the scope of the disclosure. The same reference numerals are used to identify the same structure in different figures unless specified otherwise. The structures in the figures are not drawn according to their relative proportions and the drawings should not be interpreted as limiting the disclosure in size, relative size, or location. In addition, though the discussion will address negatively charged systems, the imaging members of the present disclosure may also be used in positively charged systems.

FIG. 1 is an exemplary embodiment of a multilayered electrophotographic imaging member having a drum configuration. As can be seen, the exemplary imaging member includes a rigid support substrate 10, an electrically conductive ground plane 12, an undercoat layer 14, a charge generation layer 18 and a charge transport layer 20. The rigid substrate may be comprised of a material selected from the group consisting of a metal, metal alloy, aluminum, zirconium, niobium, tantalum, vanadium, hafnium, titanium, nickel, stainless steel, chromium, tungsten, molybdenum, and mixtures thereof. The charge generation layer 18 and the charge transport layer 20 forms an imaging layer described here as two separate layers. In an alternative to what is shown in the figure, the charge generation layer may also be disposed on top of the charge transport layer. It will be appreciated that the functional components of these layers may alternatively be combined into a single layer.

Figure 2:
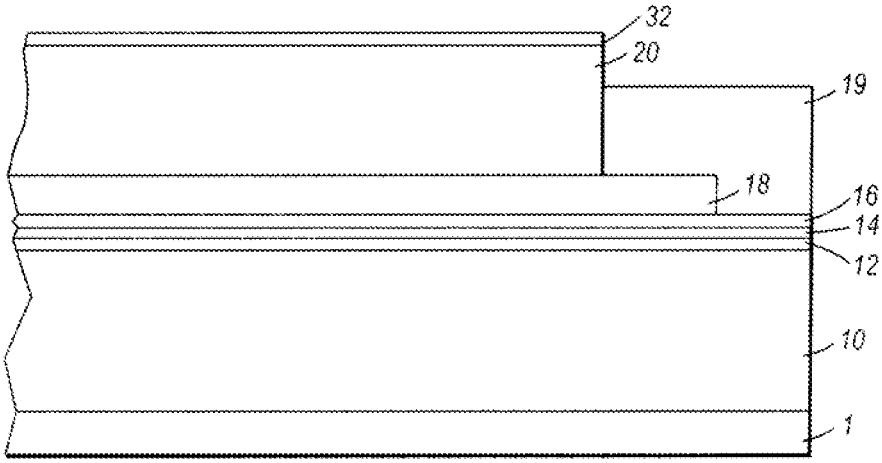
FIG. 2 is a cross-sectional view of an imaging member in a belt configuration according to the present embodiments.

FIG. 2 shows an imaging member having a belt configuration according to the embodiments. As shown, the belt configuration is provided with an anti-curl back coating 1, a supporting substrate 10, an electrically conductive ground plane 12, an undercoat layer 14, an adhesive layer 16, a charge generation layer 18, and a charge transport layer 20. An optional overcoat layer 32 and ground strip 19 may also be included. An exemplary photoreceptor having a belt configuration is disclosed in U.S. Pat. No. 5,069,993, which is hereby incorporated by reference.

Print defects due to cleaning failure and high torque in drum configuration are some of the main issues in xerographic sub-systems, and typically observed when a low wear overcoated photoreceptor is used. Such defects are typically observed when a low wear overcoated photoreceptor is used. For example, the defects often occur at a very early stage and can be seen in blade chipping due to high friction and poor interactions between the cleaning blade and the photoreceptor which adversely impacts print quality.

In the present embodiments, it is discovered that one manner in which to address these problems is to impart a specific surface morphology on the photoreceptor. For example, U.S. Pat. No. 8,227,166 and U.S. Publication No. 2011-0014557, which are hereby incorporated by reference in their entirety, generally disclose a xerographic photoreceptor with a uniform roughened surface on the outer layer and methods for making the same. The use of such a photoreceptor that includes a nano- to micron-scale surface-structured outer layer by employing a micro/nano imprinting method was shown to improve print quality and to minimize photoreceptor damage. However, U.S. Pat. No. 8,227,166 and U.S. Publication No. 2011-0014557 do not address how to use photoreceptor surface morphology to reduce cleaning blade damage and thus extend cleaning blade life.

In the present embodiments, there is provided an imaging system that extends the life and improves the cleaning ability of the cleaning blade in the cleaning unit. In embodiments, the imaging system includes a photoreceptor having a specifically patterned outer surface, for example, a specifically patterned over coat layer. It has been discovered that implementing the proper pattern structure on the surface of the photoreceptor can reduce friction by more than 20 percent between the photoreceptor and the cleaning blade, thus significantly eliminating blade damage. Optical micrographs further show less chipping of the cleaning blade after several thousands of printing cycles when a surface patterned photoreceptor of the present embodiments is used in place of a conventional photoreceptor (smooth surface with no surface pattern). Furthermore, testing of the imaging system shows that there is no negative impact on image quality. As such, the present embodiments provide the optimal surface pattern on the photoreceptor to minimize wear and damage to the cleaning blade.

Figure 3:
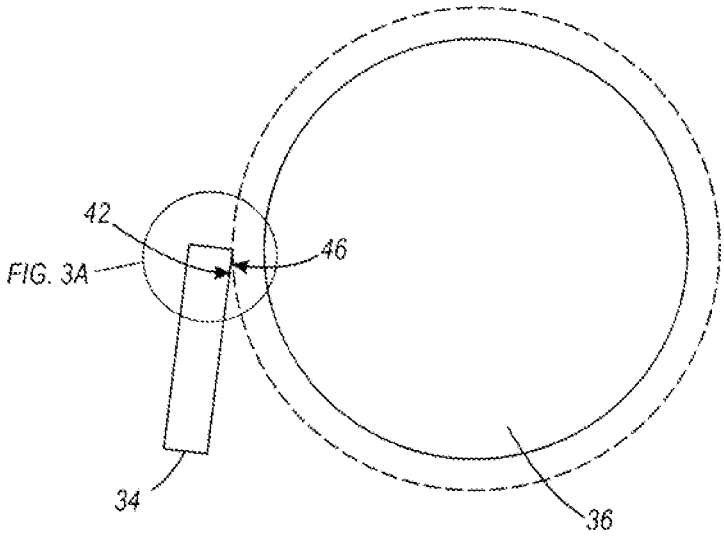
FIG. 3 is an illustration of an image-forming apparatus according to the present embodiments.
Figure 3A:
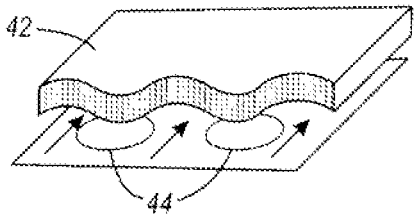
FIG. 3A is a magnified view of the interaction between the cleaning unit and the surface of an imaging member according to the present embodiments.

In the present embodiments, the reduction of friction between the cleaning blade and photoreceptor is based on the material and contact area between a cleaning unit and photoreceptor. In embodiments, the cleaning blade comprises an elastic material, for example, a polymer material selected from the group consisting of polyurethanes, polyesters, polycarbonates, acrylic resin, epoxy resin, and copolymers or mixtures thereof. In embodiments, the cleaning unit comprises an elastic polymer having a hardness of from about 60 Shore A to about 120 Shore A, or from about 70 Shore A to about 100 Shore A. In addition, blade damage is further reduced by avoiding large mechanical stress build-up in the cleaning blade. In FIG. 3, it can be seen how the material and contact area impacts the friction between the cleaning unit and photoreceptor. FIG. 3 illustrates the general concept of lowering the friction between the cleaning unit 34, such as a cleaning blade, with a surface patterned photoreceptor 36. As shown in a magnified view in FIG. 3A, the cleaning unit 34 comprises an elastic material and has one of its edges in contact with the photoreceptor 36 such that the contact edge 42 of the cleaning unit 34 deforms at a micro-scale level to complement the surface pattern 44 of the photoreceptor 36 (e.g., the contact edge deforms so as to become the reverse of the surface pattern of the photoreceptor) thus avoiding mechanical stress build-up in large portions of the cleaning blade. When a print is complete, the cleaning unit 34 cleans any excess toner from the photoreceptor 36 and deposits it into a waste reservoir. FIGS. 3 and 3A show how the interaction between the blade edge and patterned surface of the photoreceptor can be expected to experience lower friction than the interaction with a smooth surface of a conventional photoreceptor, while reducing large stress build-up due to blade deformation upon the contact with the P/R surface. Surface bumps or depressions can prevent very large local deformations by spreading strain out into many smaller deformations requiring less energy and generating lower blade stress. As such, the contact area between the blade edge and patterned surface of the photoreceptor is much less in comparison. The lower friction allows for good cleaning performance across the entire photoreceptor as well as eliminates early blade damages due to chipping.

In embodiments, a surface pattern is inlayed or imprinted onto an outer layer of the photoreceptor. The outer layer may be a charge transport layer or an overcoat layer. As shown in FIG. 3, the surface pattern 44 may include specific shapes and dimensions. For example, the surface pattern may comprise circles, rods, squares, triangles, oval, polygons, mixtures thereof and the like. In FIG. 3, the surface pattern 44 is represented as one or more protrusions. In other embodiments, the surface pattern may also include one or more indentations. In embodiments, the surface pattern may include an array of indentations having a depth of less than 3 micrometers. In further embodiments, the surface pattern has a depth of from about 0.05 micrometer to about 3 micrometers, or from about 1 micrometer to about 2 micrometers. These depth dimensions are selected to prevent toner particle (e.g. about 5 to about 20 micrometers in diameter) from being stuck inside the pattern. In further embodiments, the surface pattern comprises an array of indentations having a diameter of from about 0.1 to about 50 microns, or from about 0.5 to about 35 microns, or from about 1 to about 30 microns, or about 30 microns up to about 50 microns. In other embodiments, the array of indentations has a center-to-center distance of from about 1 to about 200 microns, or from about 5 to about 150, or from about 10 to about 100 microns. In further embodiments, the surface pattern may comprise micro-grooves formed along the moving direction of the imaging member. In such embodiments, the micro-groove has a depth of from about 0.1 micrometer to about 3 micrometers and a width of from about 0.01 micrometer to about 100 micrometers.

To achieve a surface pattern that significantly minimizes wear or damage to the cleaning blade, the surface pattern is designed such that the contact area fraction f between the surface area of the imaging member comprising the surface pattern and the entire surface area of the imaging member ranges from about 50 percent to about 90 percent. Specifically, for a surface pattern having protrusions, the fraction f1 between the surface area of the imaging member comprising the protrusions and the entire surface area of the imaging member ranges from about 50 percent to about 90 percent. For a surface pattern having indentations, the fraction f2 between the surface area of the imaging member minus the surface area comprising the indentations and the entire surface area of the imaging member ranges from about 50 percent to about 90 percent. In further embodiments, the contact fraction is from about 75 percent to 87 percent, or is less than 80 percent.

The surface pattern may include indentations being of equidistance from one another in an evenly distributed pattern across the surface of the overcoat layer of the photoreceptor and forming a uniform roughened pattern on the surface of the photoreceptor. The indentations may also be in the shape of circles, rods, squares, triangles, polygons, mixtures thereof, and the like. Alternative patterns may include periodic or non-periodic hole arrays, two-dimensional crystalline hexagonal patterns, rectangular arrays of patterns or quasi-crystalline array of patterns.

In addition, as described above, the surface pattern may comprise an array of protrusions or bumps. These bumps may likewise be in the shape of circles, rods, squares, triangles, polygons, mixtures thereof and the like. The dimensions would remain the same as discussed for the indentations above, however, the dimension for depth will be reversed to a dimension for height. Thus, the protrusions may have a height of less than 3 micrometers, or from a height of from about 0.05 micrometer to about 3 micrometers or from about 1 micrometer to about 2 micrometers.

In further embodiments, there is provided an imaging forming apparatus comprising an imaging member or photoreceptor as described above, a charging unit that applies electrostatic charge on the imaging member, a developing unit that develops toner image onto the imaging member, a transfer unit that transfers the toner image from the imaging member to a media, and a cleaning unit that cleans the imaging member. In such embodiments, the photoreceptor has a surface pattern as described above. In embodiments, the cleaning unit of the image forming apparatus may comprise a blade-type cleaner comprised of an elastic polymer.

The Overcoat Layer

Other layers of the imaging member may include, for example, an optional over coat layer 32. An optional overcoat layer 32, if desired, may be disposed over the charge transport layer 20 to provide imaging member surface protection as well as improve resistance to abrasion. In embodiments, the overcoat layer 32 may have a thickness ranging from about 0.1 micrometer to about 25 micrometers or from about 1 micrometer to about 15 micrometers, or in a specific embodiment, about 3 to about 10 micrometers. These overcoating layers may include a charge transport component and an optional organic polymers or inorganic polymers.

In embodiments, the overcoat layer may include a charge transport component. In particular embodiments, the overcoat layer comprises a charge transport component comprised of a tertiary arylamine containing a substituent capable of self cross-linking or reacting with the polymer resin to form cured composition. Specific examples of charge transport component suitable for overcoat layer comprise the tertiary arylamine with a general formula of

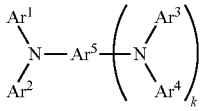

wherein $Ar^1$, $Ar^2$, $Ar^3$, and $Ar^4$ each independently represents an aryl group having about 6 to about 30 carbon atoms, $Ar^5$ represents aromatic hydrocarbon group having about 6 to about 30 carbon atoms, and k represents 0 or 1, and wherein at least one of $Ar^1$, $Ar^2$, $Ar^3$ $Ar^4$, and $Ar^5$ comprises a substituent selected from the group consisting of hydroxyl (—OH), a hydroxymethyl (—$CH_2OH$), an alkoxymethyl (—$CH_2OR$, wherein R is an alkyl having 1 to about 10 carbons), a hydroxylalkyl having 1 to about 10 carbons, and mixtures thereof. In other embodiments, $Ar^1$, $Ar^2$, $Ar^3$, and $Ar^4$ each independently represent a phenyl or a substituted phenyl group, and $Ar^5$ represents a biphenyl or a terphenyl group.

Additional examples of charge transport component which comprise a tertiary arylamine include the following:

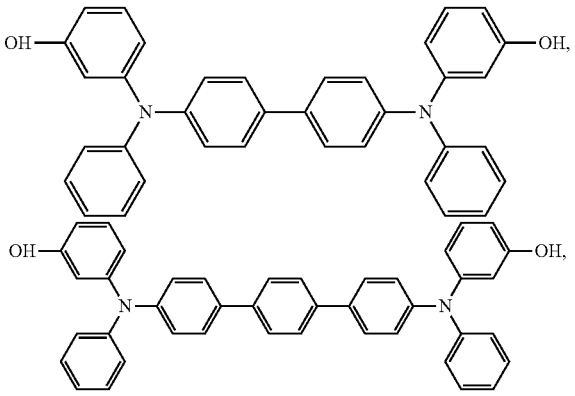

-continued

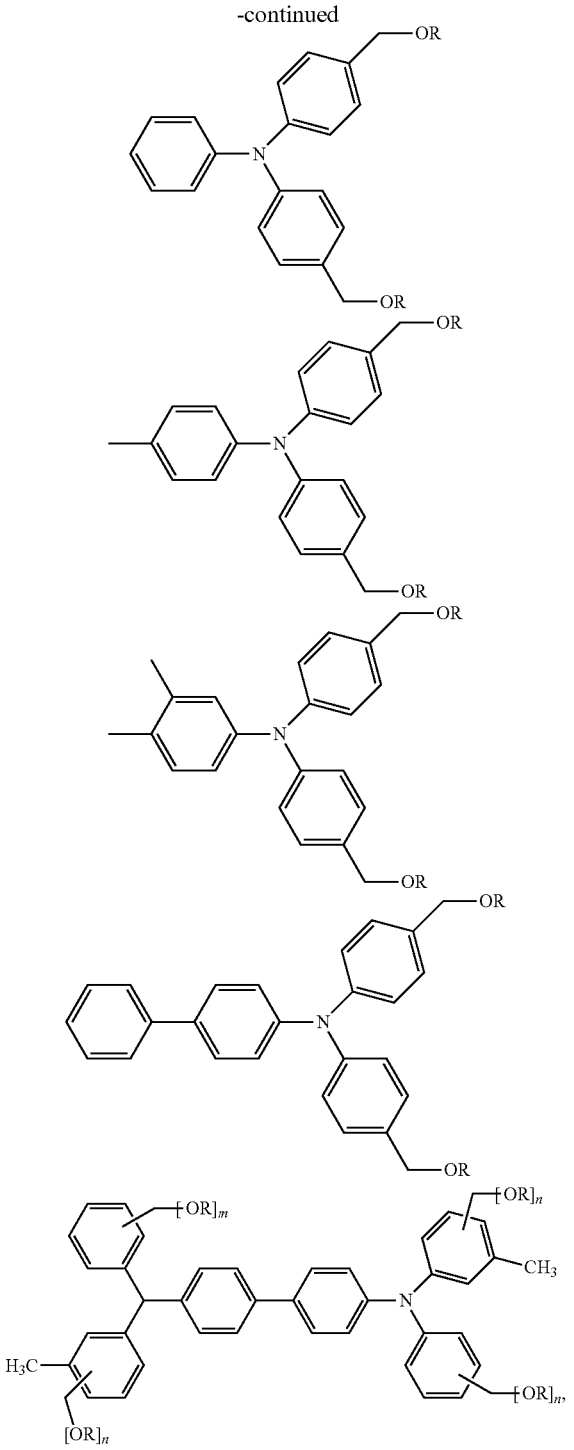

and the like, wherein R is a substituent selected from the group consisting of hydrogen atom, and an alkyl having from 1 to about 6 carbons, and m and n each independently represents 0 or 1, wherein m+n>1. In specific embodiments, the overcoat layer may include an additional curing agent to form a cured, crosslinked overcoat composition. Illustrative examples of the curing agent may be selected from the group consisting of a melamine-formaldehyde resin, a phenol resin, an isocyalate or a masking isocyalate compound, an acrylate resin, a polyol resin, or the mixture thereof. In embodiments, the crosslinked overcoat composition has an average modulus ranging from about 3 GPa to about 5 GPa, as measured by nano-indentation method using, for example, nanomechanical test instruments manufactured by Hysitron Inc. (Minneapolis, Minn.).

The Substrate

The photoreceptor support substrate 10 may be opaque or substantially transparent, and may comprise any suitable organic or inorganic material having the requisite mechanical properties. The entire substrate can comprise the same material as that in the electrically conductive surface, or the electrically conductive surface can be merely a coating on the substrate. Any suitable electrically conductive material can be employed, such as for example, metal or metal alloy. Electrically conductive materials include copper, brass, nickel, zinc, chromium, stainless steel, conductive plastics and rubbers, aluminum, semitransparent aluminum, steel, cadmium, silver, gold, zirconium, niobium, tantalum, vanadium, hafnium, titanium, nickel, niobium, stainless steel, chromium, tungsten, molybdenum, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. It could be single metallic compound or dual layers of different metals and/or oxides.

The substrate 10 can also be formulated entirely of an electrically conductive material, or it can be an insulating material including inorganic or organic polymeric materials, such as MYLAR, a commercially available biaxially oriented polyethylene terephthalate from DuPont, or polyethylene naphthalate available as KALEDEX 2000, with a ground plane layer 12 comprising a conductive titanium or titanium/zirconium coating, otherwise a layer of an organic or inorganic material having a semiconductive surface layer, such as indium tin oxide, aluminum, titanium, and the like, or exclusively be made up of a conductive material such as, aluminum, chromium, nickel, brass, other metals and the like. The thickness of the support substrate depends on numerous factors, including mechanical performance and economic considerations.

The substrate 10 may have a number of many different configurations, such as for example, a plate, a cylinder, a drum, a scroll, an endless flexible belt, and the like. In the case of the substrate being in the form of a belt, as shown in FIG. 2, the belt can be seamed or seamless. In embodiments, the photoreceptor herein is in a drum configuration.

The thickness of the substrate 10 depends on numerous factors, including flexibility, mechanical performance, and economic considerations. The thickness of the support substrate 10 of the present embodiments may be at least about 500 micrometers, or no more than about 3,000 micrometers, or be at least about 750 micrometers, or no more than about 2500 micrometers.

The Ground Plane

The electrically conductive ground plane 12 may be an electrically conductive metal layer which may be formed, for example, on the substrate 10 by any suitable coating technique, such as a vacuum depositing technique. Metals include aluminum, zirconium, niobium, tantalum, vanadium, hafnium, titanium, nickel, stainless steel, chromium, tungsten, molybdenum, and other conductive substances, and mixtures thereof. The conductive layer may vary in thickness over substantially wide ranges depending on the optical transparency and flexibility desired for the electrophotoconductive member. Accordingly, for a flexible photoresponsive imaging device, the thickness of the conductive layer may be at least about 20 Angstroms, or no more than about 750 Angstroms, or at least about 50 Angstroms, or no more than about 200 Angstroms for an optimum combination of electrical conductivity, flexibility and light transmission.

Regardless of the technique employed to form the metal layer, a thin layer of metal oxide forms on the outer surface of most metals upon exposure to air. Thus, when other layers overlying the metal layer are characterized as "contiguous" layers, it is intended that these overlying contiguous layers may, in fact, contact a thin metal oxide layer that has formed on the outer surface of the oxidizable metal layer. Generally, for rear erase exposure, a conductive layer light transparency of at least about 15 percent is desirable. The conductive layer need not be limited to metals. Other examples of conductive layers may be combinations of materials such as conductive indium tin oxide as transparent layer for light having a wavelength between about 4000 Angstroms and about 9000 Angstroms or a conductive carbon black dispersed in a polymeric binder as an opaque conductive layer.

The Hole Blocking Layer

After deposition of the electrically conductive ground plane layer, the hole blocking layer 14 may be applied thereto. Electron blocking layers for positively charged photoreceptors allow holes from the imaging surface of the photoreceptor to migrate toward the conductive layer. For negatively charged photoreceptors, any suitable hole blocking layer capable of forming a barrier to prevent hole injection from the conductive layer to the opposite photoconductive layer may be utilized. The hole blocking layer may include polymers such as polyvinylbutryral, epoxy resins, polyesters, polysiloxanes, polyamides, polyurethanes and the like, or may be nitrogen containing siloxanes or nitrogen containing titanium compounds such as trimethoxysilyl propylene diamine, hydrolyzed trimethoxysilyl propyl ethylene diamine, N-beta-(aminoethyl) gamma-amino-propyl trimethoxy silane, isopropyl 4-aminobenzene sulfonyl, di(dodecylbenzene sulfonyl) titanate, isopropyl di(4-aminobenzoyl)isostearoyl titanate, isopropyl tri(N-ethylamino-ethylamino)titanate, isopropyl trianthranil titanate, isopropyl tri(N,N-dimethyl-ethylamino)titanate, titanium-4-amino benzene sulfonate oxyacetate, titanium 4-aminobenzoate isostearate oxyacetate, $[H_2N(CH_2)_4]CH_3Si(OCH_3)_2$, (gamma-aminobutyl) methyl diethoxysilane, and $[H_2N(CH_2)_3]CH_3Si(OCH_3)_2$ (gamma-aminopropyl)methyl diethoxysilane, as disclosed in U.S. Pat. Nos. 4,338,387, 4,286,033 and 4,291,110.

General embodiments of the undercoat layer may comprise a metal oxide and a resin binder. The metal oxides that can be used with the embodiments herein include, but are not limited to, titanium oxide, zinc oxide, tin oxide, aluminum oxide, silicon oxide, zirconium oxide, indium oxide, molybdenum oxide, and mixtures thereof. Undercoat layer binder materials may include, for example, polyesters, MOR-ESTER 49,000 from Morton International Inc., VITEL PE-100, VITEL PE-200, VITEL PE-200D, and VITEL PE-222 from Goodyear Tire and Rubber Co., polyarylates such as ARDEL from AMOCO Production Products, polysulfone from AMOCO Production Products, polyurethanes, and the like.

The hole blocking layer should be continuous and have a thickness of less than about 0.5 micrometer because greater thicknesses may lead to undesirably high residual voltage. A hole blocking layer of between about 0.005 micrometer and about 0.3 micrometer is used because charge neutralization after the exposure step is facilitated and optimum electrical performance is achieved. A thickness of between about 0.03 micrometer and about 0.06 micrometer is used for hole blocking layers for optimum electrical behavior. The blocking layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layer is applied in the form of a dilute solution, with the solvent being removed after deposition of the coating by conventional techniques such as by vacuum, heating and the like. Generally, a weight ratio of hole blocking layer material and solvent of between about 0.05:100 to about 0.5:100 is satisfactory for spray coating.

The Charge Generation Layer

The charge generation layer 18 may thereafter be applied to the undercoat layer 14. Any suitable charge generation binder including a charge generating/photoconductive material, which may be in the form of particles and dispersed in a film forming binder, such as an inactive resin, may be utilized. Examples of charge generating materials include, for example, inorganic photoconductive materials such as amorphous selenium, trigonal selenium, and selenium alloys selected from the group consisting of selenium-tellurium, selenium-tellurium-arsenic, selenium arsenide and mixtures thereof, and organic photoconductive materials including various phthalocyanine pigments such as the X-form of metal free phthalocyanine, metal phthalocyanines such as vanadyl phthalocyanine and copper phthalocyanine, hydroxy gallium phthalocyanines, chlorogallium phthalocyanines, titanyl phthalocyanines, quinacridones, dibromo anthanthrone pigments, benzimidazole perylene, substituted 2,4-diamino-triazines, polynuclear aromatic quinones, enzimidazole perylene, and the like, and mixtures thereof, dispersed in a film forming polymeric binder. Selenium, selenium alloy, benzimidazole perylene, and the like and mixtures thereof may be formed as a continuous, homogeneous charge generation layer. Benzimidazole perylene compositions are well known and described, for example, in U.S. Pat. No. 4,587,189, the entire disclosure thereof being incorporated herein by reference. Multi-charge generation layer compositions may be used where a photoconductive layer enhances or reduces the properties of the charge generation layer. Other suitable charge generating materials known in the art may also be utilized, if desired. The charge generating materials selected should be sensitive to activating radiation having a wavelength between about 400 and about 900 nm during the imagewise radiation exposure step in an electrophotographic imaging process to form an electrostatic latent image. For example, hydroxygallium phthalocyanine absorbs light of a wavelength of from about 370 to about 950 nanometers, as disclosed, for example, in U.S. Pat. No. 5,756,245.

Any suitable inactive resin materials may be employed as a binder in the charge generation layer 18, including those described, for example, in U.S. Pat. No. 3,121,006, the entire disclosure thereof being incorporated herein by reference. Organic resinous binders include thermoplastic and thermosetting resins such as one or more of polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl butyral, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride/vinylchloride copolymers, vinylacetate/vinylidene chloride copolymers, styrene-alkyd resins, and the like. Another film-forming polymer binder is PCZ-400 (poly (4,4'-dihydroxy-diphenyl-1-1-cyclohexane) which has a viscosity-molecular weight of 40,000 and is available from Mitsubishi Gas Chemical Corporation (Tokyo, Japan).

The charge generating material can be present in the resinous binder composition in various amounts. Generally, at least about 5 percent by volume, or no more than about 90 percent by volume of the charge generating material is dispersed in at least about 95 percent by volume, or no more than about 10 percent by volume of the resinous binder, and more specifically at least about 20 percent, or no more than about 60 percent by volume of the charge generating material is dispersed in at least about 80 percent by volume, or no more than about 40 percent by volume of the resinous binder composition.

In specific embodiments, the charge generation layer 18 may have a thickness of at least about 0.1 μm, or no more than about 2 μm, or of at least about 0.2 μm, or no more than about 1 μm. These embodiments may be comprised of chlorogallium phthalocyanine or hydroxygallium phthalocyanine or mixtures thereof. The charge generation layer 18 containing the charge generating material and the resinous binder material generally ranges in thickness of at least about 0.1 μm, or no more than about 5 μm, for example, from about 0.2 μm to about 3 μm when dry. The charge generation layer thickness is generally related to binder content. Higher binder content compositions generally employ thicker layers for charge generation.

The Charge Transport Layer

In a drum photoreceptor, the charge transport layer comprises a single layer of the same composition. As such, the charge transport layer will be discussed specifically in terms of a single layer 20, but the details will be also applicable to an embodiment having dual charge transport layers. The charge transport layer 20 is thereafter applied over the charge generation layer 18 and may include any suitable transparent organic polymer or non-polymeric material capable of supporting the injection of photogenerated holes or electrons from the charge generation layer 18 and capable of allowing the transport of these holes/electrons through the charge transport layer to selectively discharge the surface charge on the imaging member surface. In one embodiment, the charge transport layer 20 not only serves to transport holes, but also protects the charge generation layer 18 from abrasion or chemical attack and may therefore extend the service life of the imaging member. The charge transport layer 20 can be a substantially non-photoconductive material, but one which supports the injection of photogenerated holes from the charge generation layer 18.

The layer 20 is normally transparent in a wavelength region in which the electrophotographic imaging member is to be used when exposure is affected there to ensure that most of the incident radiation is utilized by the underlying charge generation layer 18. The charge transport layer should exhibit excellent optical transparency with negligible light absorption and no charge generation when exposed to a wavelength of light useful in xerography, e.g., 400 to 900 nanometers. In the case when the photoreceptor is prepared with the use of a transparent substrate 10 and also a transparent or partially transparent conductive layer 12, image wise exposure or erase may be accomplished through the substrate 10 with all light passing through the back side of the substrate. In this case, the materials of the layer 20 need not transmit light in the wavelength region of use if the charge generation layer 18 is sandwiched between the substrate and the charge transport layer 20. The charge transport layer 20 in conjunction with the charge generation layer 18 is an insulator to the extent that an electrostatic charge placed on the charge transport layer is not conducted in the absence of illumination. The charge transport layer 20 should trap minimal charges as the charge passes through it during the discharging process.

The charge transport layer 20 may include any suitable charge transport component or activating compound useful as an additive dissolved or molecularly dispersed in an electrically inactive polymeric material, such as a polycarbonate binder, to form a solid solution and thereby making this material electrically active. "Dissolved" refers, for example, to forming a solution in which the small molecule is dissolved in the polymer to form a homogeneous phase; and molecularly dispersed in embodiments refers, for example, to charge transporting molecules dispersed in the polymer, the small molecules being dispersed in the polymer on a molecular scale. The charge transport component may be added to a film forming polymeric material which is otherwise incapable of supporting the injection of photogenerated holes from the charge generation material and incapable of allowing the transport of these holes through. This addition converts the electrically inactive polymeric material to a material capable of supporting the injection of photogenerated holes from the charge generation layer 18 and capable of allowing the transport of these holes through the charge transport layer 20 in order to discharge the surface charge on the charge transport layer. The high mobility charge transport component may comprise small molecules of an organic compound which cooperate to transport charge between molecules and ultimately to the surface of the charge transport layer. For example, but not limited to, N,N'-diphenyl-N,N-bis(3-methyl phenyl)-1,1'-biphenyl-4,4'-diamine (TPD), other arylamines like triphenyl amine, N,N,N',N'-tetra-p-tolyl-1,1'-biphenyl-4,4'-diamine (TM-TPD), and the like.

A number of charge transport compounds can be included in the charge transport layer, which layer generally is of a thickness of from about 5 to about 75 micrometers, and more specifically, of a thickness of from about 15 to about 40 micrometers. Examples of charge transport components are aryl amines of the following formulas/structures:

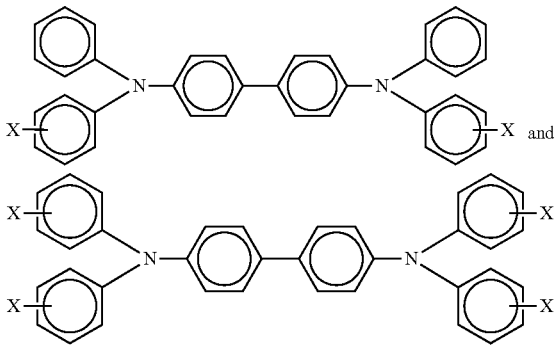

wherein X is a suitable hydrocarbon like alkyl, alkoxy, aryl, and derivatives thereof; a halogen, or mixtures thereof, and especially those substituents selected from the group consisting of Cl and $CH_3$; and molecules of the following formulas

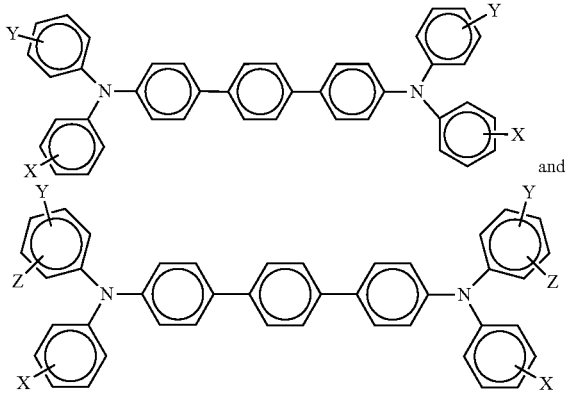

wherein X, Y and Z are independently alkyl, alkoxy, aryl, a halogen, or mixtures thereof, and wherein at least one of Y and Z are present.

Alkyl and alkoxy contain, for example, from 1 to about 25 carbon atoms, and more specifically, from 1 to about 12 carbon atoms, such as methyl, ethyl, propyl, butyl, pentyl, and the corresponding alkoxides. Aryl can contain from 6 to about 36 carbon atoms, such as phenyl, and the like. Halogen includes chloride, bromide, iodide, and fluoride. Substituted alkyls, alkoxys, and aryls can also be selected in embodiments.

Examples of specific aryl amines that can be selected for the charge transport layer include N,N'-diphenyl-N,N'-bis(alkylphenyl)-1,1-biphenyl-4,4'-diamine wherein alkyl is selected from the group consisting of methyl, ethyl, propyl, butyl, hexyl, and the like; N,N'-diphenyl-N,N'-bis(halophenyl)-1,1'-biphenyl-4,4'-diamine wherein the halo substituent is a chloro substituent; N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4"-diamine, and the like. Other known charge transport layer molecules may be selected in embodiments, reference for example, U.S. Pat. Nos. 4,921,773 and 4,464,450, the disclosures of which are totally incorporated herein by reference.

Examples of the binder materials selected for the charge transport layers include components, such as those described in U.S. Pat. No. 3,121,006, the disclosure of which is totally incorporated herein by reference. Specific examples of polymer binder materials include polycarbonates, polyarylates, acrylate polymers, vinyl polymers, cellulose polymers, polyesters, polysiloxanes, polyamides, polyurethanes, poly(cyclo olefins), and epoxies, and random or alternating copolymers thereof. In embodiments, the charge transport layer, such as a hole transport layer, may have a thickness of at least about 10 μm, or no more than about 40 μm.

Examples of components or materials optionally incorporated into the charge transport layers or at least one charge transport layer to, for example, enable improved lateral charge migration (LCM) resistance include hindered phenolic antioxidants such as tetrakis methylene(3,5-di-tert-butyl-4-hydroxy hydrocinnamate) methane (IRGANOX® 1010, available from Ciba Specialty Chemical), butylated hydroxytoluene (BHT), and other hindered phenolic antioxidants including SUMILIZER™ BHT-R, MDP-S, BBM-S, WX-R, NR, BP-76, BP-101, GA-80, GM and GS (available from Sumitomo Chemical Co., Ltd.), IRGANOX® 1035, 1076, 1098, 1135, 1141, 1222, 1330, 1425WL, 1520L, 245, 259, 3114, 3790, 5057 and 565 (available from Ciba Specialties Chemicals), and ADEKA STAB™ AO-20, AO-30, AO-40, AO-50, AO-60, AO-70, AO-80 and AO-330 (available from Asahi Denka Co., Ltd.); hindered amine antioxidants such as SANOL™ LS-2626, LS-765, LS-770 and LS-744 (available from SANKYO CO., Ltd.), TINUVIN® 144 and 622LD (available from Ciba Specialties Chemicals), MARK™ LA57, LA67, LA62, LA68 and LA63 (available from Asahi Denka Co., Ltd.), and SUMILIZER® TPS (available from Sumitomo Chemical Co., Ltd.); thioether antioxidants such as SUMILIZER® TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules such as bis(4-diethylamino-2-methylphenyl)phenylmethane (BDETPM), bis-[2-methyl-4-(N-2-hydroxyethyl-N-ethylaminophenyl)]-phenylmethane (DHTPM), and the like. The weight percent of the antioxidant in at least one of the charge transport layer is from about 0 to about 20, from about 1 to about 10, or from about 3 to about 8 weight percent.

The charge transport layer should be an insulator to the extent that the electrostatic charge placed on the hole transport layer is not conducted in the absence of illumination at a rate sufficient to prevent formation and retention of an electrostatic latent image thereon. The charge transport layer is substantially nonabsorbing to visible light or radiation in the region of intended use, but is electrically "active" in that it allows the injection of photogenerated holes from the photoconductive layer, that is the charge generation layer, and allows these holes to be transported through itself to selectively discharge a surface charge on the surface of the active layer.

In addition, in the present embodiments using a belt configuration, the charge transport layer may consist of a single pass charge transport layer or a dual pass charge transport layer (or dual layer charge transport layer) with the same or different transport molecule ratios. In these embodiments, the dual layer charge transport layer has a total thickness of from about 10 μm to about 40 μm. In other embodiments, each layer of the dual layer charge transport layer may have an individual thickness of from 2 μm to about 20 μm. Moreover, the charge transport layer may be configured such that it is used as a top layer of the photoreceptor to inhibit crystallization at the interface of the charge transport layer and the overcoat layer. In another embodiment, the charge transport layer may be configured such that it is used as a first pass charge transport layer to inhibit microcrystallization occurring at the interface between the first pass and second pass layers.

In specific embodiments, where the charge transport layer is the outermost layer, the charge transport layer may be surface patterned as described above in reference to the overcoat layer. The surface pattern will offer, as when used in connection with the overcoat layer, numerous unexpected benefits such as, for example, lower friction with the cleaning blade, improved print quality and smoother interaction to minimize blade damage, and consequently longer service life.

Any suitable and conventional technique may be utilized to form and thereafter apply the charge transport layer mixture to the supporting substrate layer. The charge transport layer may be formed in a single coating step or in multiple coating steps. Dip coating, ring coating, spray, gravure or any other drum coating methods may be used.

Drying of the deposited coating may be effected by any suitable conventional technique such as oven drying, infra red radiation drying, air drying and the like. The thickness of the charge transport layer after drying is from about 10 μm to about 40 μm or from about 12 μm to about 36 μm for optimum photoelectrical and mechanical results. In another embodiment the thickness is from about 14 μm to about 36 μm.

The Adhesive Layer

An optional separate adhesive interface layer may be provided in certain configurations, such as for example, in flexible web configurations. In the embodiment illustrated in FIG. 1, the interface layer would be situated between the blocking layer 14 and the charge generation layer 18. The interface layer may include a copolyester resin. Exemplary polyester resins which may be utilized for the interface layer include polyarylatepolyvinylbutyrals, such as ARDEL POLYARYLATE (U-100) commercially available from Toyota Hsutsu Inc., VITEL PE-100, VITEL PE-200, VITEL PE-200D, and VITEL PE-222, all from Bostik, 49,000 polyester from Rohm Hass, polyvinyl butyral, and the like. The adhesive interface layer may be applied directly to the hole blocking layer 14. Thus, the adhesive interface layer in embodiments is in direct contiguous contact with both the underlying hole blocking layer 14 and the overlying charge generator layer 18 to enhance adhesion bonding to provide linkage. In yet other embodiments, the adhesive interface layer is entirely omitted.

Any suitable solvent or solvent mixtures may be employed to form a coating solution of the polyester for the adhesive interface layer. Solvents may include tetrahydrofuran, toluene, monochlorobenzene, methylene chloride, cyclohexanone, and the like, and mixtures thereof. Any other suitable and conventional technique may be used to mix and thereafter apply the adhesive layer coating mixture to the hole blocking layer. Application techniques may include spraying, dip coating, roll coating, wire wound rod coating, and the like. Drying of the deposited wet coating may be effected by any suitable conventional process, such as oven drying, infra red radiation drying, air drying, and the like.

The adhesive interface layer may have a thickness of at least about 0.01 micrometers, or no more than about 900 micrometers after drying. In embodiments, the dried thickness is from about 0.03 micrometers to about 1 micrometer.

The Ground Strip

The ground strip may comprise a film forming polymer binder and electrically conductive particles. Any suitable electrically conductive particles may be used in the electrically conductive ground strip layer 19. The ground strip 19 may comprise materials which include those enumerated in U.S. Pat. No. 4,664,995. Electrically conductive particles include carbon black, graphite, copper, silver, gold, nickel, tantalum, chromium, zirconium, vanadium, niobium, indium tin oxide and the like. The electrically conductive particles may have any suitable shape. Shapes may include irregular, granular, spherical, elliptical, cubic, flake, filament, and the like. The electrically conductive particles should have a particle size less than the thickness of the electrically conductive ground strip layer to avoid an electrically conductive ground strip layer having an excessively irregular outer surface. An average particle size of less than about 10 micrometers generally avoids excessive protrusion of the electrically conductive particles at the outer surface of the dried ground strip layer and ensures relatively uniform dispersion of the particles throughout the matrix of the dried ground strip layer. The concentration of the conductive particles to be used in the ground strip depends on factors such as the conductivity of the specific conductive particles utilized.

The ground strip layer may have a thickness of at least about 7 micrometers, or no more than about 42 micrometers, or of at least about 14 micrometers, or no more than about 27 micrometers.

The Anti-Curl Back Coating Layer

The anti-curl back coating 1 may comprise organic polymers or inorganic polymers that are electrically insulating or slightly semi-conductive. The anti-curl back coating provides flatness and/or abrasion resistance.

Anti-curl back coating 1 may be formed at the back side of the substrate 2, opposite to the imaging layers. The anti-curl back coating may comprise a film forming resin binder and an adhesion promoter additive. The resin binder may be the same resins as the resin binders of the charge transport layer discussed above. Examples of film forming resins include polyacrylate, polystyrene, bisphenol polycarbonate, poly(4,4'-isopropylidene diphenyl carbonate), 4,4'-cyclohexylidene diphenyl polycarbonate, and the like. Adhesion promoters used as additives include 49,000 (du Pont), Vitel PE-100, Vitel PE-200, Vitel PE-307 (Goodyear), and the like. Usually from about 1 to about 15 weight percent adhesion promoter is selected for film forming resin addition. The thickness of the anti-curl back coating is at least about 3 micrometers, or no more than about 35 micrometers, or about 14 micrometers.

Various exemplary embodiments encompassed herein include a method of imaging which includes generating an electrostatic latent image on an imaging member, developing a latent image, and transferring the developed electrostatic image to a suitable substrate.

While the description above refers to particular embodiments, it will be understood that many modifications may be made without departing from the spirit thereof. The accompanying claims are intended to cover such modifications as would fall within the true scope and spirit of embodiments herein.

The presently disclosed embodiments are, therefore, to be considered in all respects as illustrative and not restrictive, the scope of embodiments being indicated by the appended claims rather than the foregoing description. All changes that come within the meaning of and range of equivalency of the claims are intended to be embraced therein.

EXAMPLES

The examples set forth herein below and is illustrative of different compositions and conditions that can be used in practicing the present embodiments. All proportions are by weight unless otherwise indicated. It will be apparent, however, that the embodiments can be practiced with many types of compositions and can have many different uses in accordance with the disclosure above and as pointed out hereinafter.

Example 1

Fabrication of Photoreceptor with Surface Pattern

An electrophotographic photoreceptor was fabricated in the following manner. A coating solution for an undercoat layer comprising 100 parts of a ziconium compound (trade name: Orgatics ZC540), 10 parts of a silane compound (trade name: A110, manufactured by Nippon Unicar Co., Ltd), 400 parts of isopropanol solution and 200 parts of butanol was prepared. The coating solution was applied onto a 30-mm cylindrical aluminum (Al) substrate subjected to honing treatment by dip coating, and dried by heating at 150° C. for 10 minutes to form an undercoat layer having a film thickness of 0.1 micrometer.

A 0.5 micron thick charge generating layer was subsequently dip coated on top of the undercoat layer from a dispersion of Type V hydroxygallium phthalocyanine (12 parts), alkylhydroxy gallium phthalocyanine (3 parts), and a vinyl chloride/vinyl acetate copolymer, VMCH (Mn=27,000, about 86 weight percent of vinyl chloride, about 13 weight percent of vinyl acetate and about 1 weight percent of maleic acid) available from Dow Chemical (10 parts), in 475 parts of n-butylacetate.

Subsequently, a 20 μm thick charge transport layer (CTL) was dip coated on top of the charge generating layer from a solution of N,N'-diphenyl-N,N'-bis(3-methylphenyl)-1,1'-biphenyl-4,4'-diamine (82.3 parts), 2.1 parts of 2,6-di-tert-butyl-4-methylphenol (BHT) from Aldrich and a polycarbonate, PCZ-400 [poly(4,4'-dihydroxy-diphenyl-1-1-cyclohexane), $M_w$=40,000] available from Mitsubishi Gas Chemical Company, Ltd. (123.5 parts) in a mixture of 546 parts of tetrahydrofuran (THF) and 234 parts of monochlorobenzene. The CTL was dried at 115° C. for 60 minutes.

Figure 6:
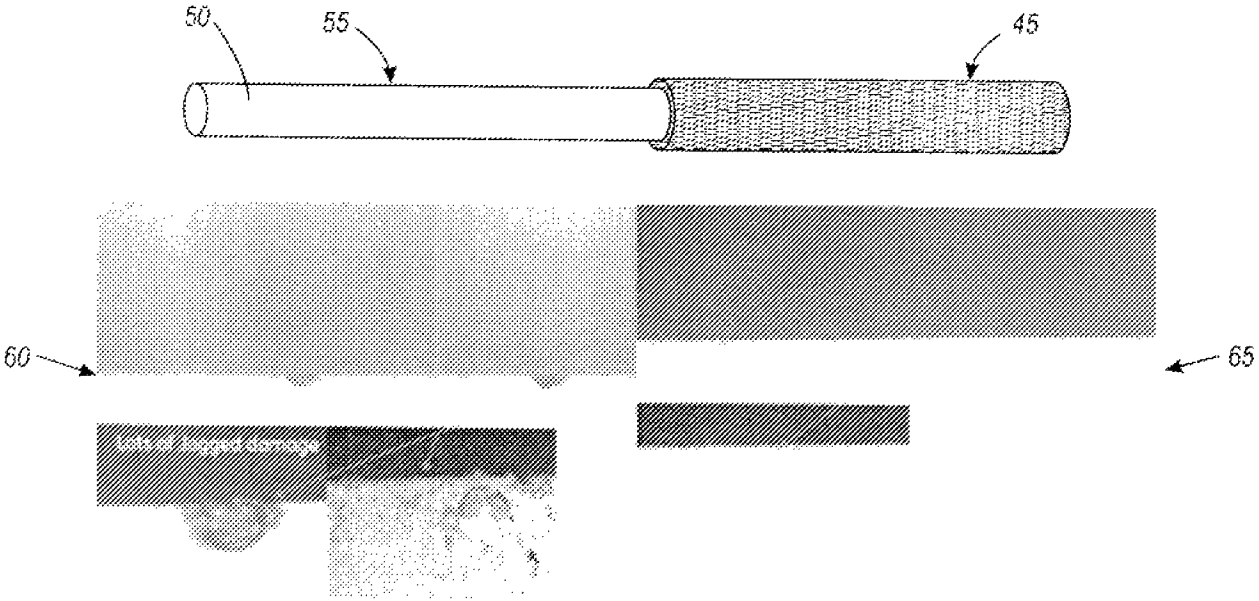
FIG. 6 is a comparative photograph showing the significantly reduced cleaning blade wear in the imaging members made according to the present embodiments as compared to a control member.

An overcoat coating solution was prepared from melamine-formaldehyde resin (3.3 parts), N,N'-diphenyl-N,N'-bis(3-hydroxyphenyl)-[1,1'-biphenyl]-4,4'-diamine (DHTBD) (6.0 parts), and an acid catalyst (0.1 part) in an alcohol solvent. After filtering with a 0.45 μm PTFE filter, the solution was applied onto the photoreceptor surface and more specifically onto the charge transport layer using cup coating technique. Half of the overcoated photoreceptor was then rolled over a silicone stamp having protrusion patterns, followed by thermal curing at 150° C. for 40 minutes to form an overcoat layer having a film thickness of 5 μm. As shown in FIG. 6, half of the overcoat material was patterned 45 and half of the overcoat material remained smooth 50 for comparison.

Figure 4:
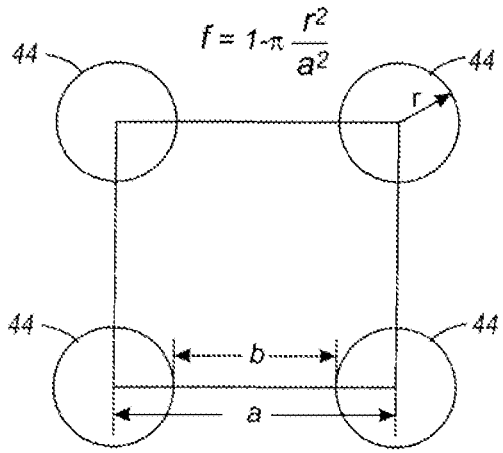
FIG. 4 is an illustration of a surface pattern according to the present embodiments.
Figure 5:
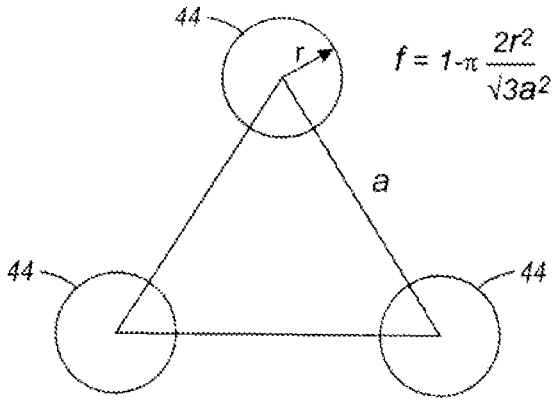
FIG. 5 is an illustration of an alternative surface pattern according to the present embodiments.

For the surface pattern, both a square lattice (FIG. 4) and a hexagonal lattice (FIG. 5) were used. As shown in FIGS. 4 and 5, the contact fraction f is defined for each pattern. The pattern comprised 40 micrometer diameter indentation dots 44. The dots 44 were uniformly formed with a center-to-center distance of about 80 micrometers. The contact fraction of the surface patterned photoreceptor was from about 75 percent to 87 percent as compared to the smooth contact area of 100%. The pattern depth was chosen as 1 micrometer to prevent the toner particles from being trapped inside.

Test Results

The fabricated photoreceptor drum 55 was put into a Xerox WCP 3545 printer photoreceptor cartridge for printing test, and was run for 10,000 prints continuously. No image quality defects were observed before and after the 10,000 prints with the photoreceptor on the section containing surface patterns.

As further shown in FIG. 6, the cleaning blade edge was investigated for wear and/or damage. The portions of the cleaning blade edge that contacted the control region of the photoreceptor 60 and the patterned region of the photoreceptor 65 were investigated with an optical microscope to see the wear. The blade region that contacted the patterned photoreceptor surface shows much smoother surface and no severe damage as compared to the blade region that contacted the control photoreceptor surface. In contrast, severe damage on the blade that contacted the control photoreceptor surface was observed. As such, the test results demonstrate that) the cleaning unit exhibits a significant reduction as compared to a cleaning unit used with an imaging member without the surface pattern.

All the patents and applications referred to herein are hereby specifically, and totally incorporated herein by reference in their entirety in the instant specification.

It will be appreciated that several of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. An image forming apparatus comprising:

an imaging member having a surface pattern on an outer layer of the imaging member, wherein the surface pattern comprises an array of periodically ordered indentations or protrusions and further wherein each indentation or protrusion has a depth of or height of less than 3 micrometers; and wherein each indentation or protrusion has a diameter in a range of from about 30 microns up to about 50 microns;

a charging unit that applies electrostatic charge on the imaging member;

a developing unit that develops toner image onto the imaging member;

a transfer unit that transfers the toner image from the imaging member to a media; and a cleaning unit that cleans the imaging member, wherein the cleaning unit comprises an elastic blade-type cleaner with one of its edge in contact with the imaging member, such that the contact edge deforms at a micro-scale level to complement the surface pattern of the imaging member, wherein the surface pattern comprises micro-grooves along the moving direction of the imaging member.

2. The image forming apparatus of claim 1, wherein each indentation or protrusion has a depth of or height of from about 0.05 to about 3 micrometers.

3. The image forming apparatus of claim 1, wherein the fraction f1 between the surface area of the imaging member comprising the protrusions and the entire surface area of the imaging member ranges from about 50 percent to about 90percent.

4. The image forming apparatus of claim 1, wherein the fraction f2 between the surface area of the imaging member minus the surface area comprising the indentations and the entire surface area of the imaging member ranges from about 50 percent to about 90 percent.

5. The image forming apparatus of claim 1, wherein the indentations or protrusions have a regular shape selected from the group consisting of circles, rods, ovals, squares, triangles, polygons, and mixtures thereof.

6. The image forming apparatus of claim 1, wherein the surface pattern comprises a square lattice or a hexagonal lattice.

7. The image forming apparatus of claim 1, wherein the micro-groove has a depth of from about 0.1 to about 3 micrometers and a width of from about 0.1 to about 100 micrometers.

8. The image forming apparatus of claim 1, wherein the blade-type cleaner comprises an elastic polymer with a hardness of from about 60 to about 120 Shore A.

9. The image forming apparatus of claim 1, wherein the imaging member comprises a photoconductive layer as the outer layer.

10. The image forming apparatus of claim 1 being a color printer comprising four or more imaging members.

11. An image forming apparatus comprising:

an imaging member further comprising a substrate, a photosensitive layer disposed over the substrate, and an overcoat layer disposed over the photosensitive layer, wherein the overcoat layer has a surface pattern comprising an array of periodically ordered indentations or protrusions and further wherein each indentation or protrusion has a depth of or height of less than 3 micrometers; and wherein each indentation or protrusion has a diameter in a range of from about 30 microns up to about 50 microns;

a charging unit that applies electrostatic charge on the imaging member;

a developing unit that develops toner image onto the imaging member;

a transfer unit that transfers the toner image from the imaging member to a media; and a cleaning unit that cleans the imaging member, wherein the cleaning unit comprises an elastic cleaning blade with one of its edge in contact with the imaging member, such that the contact edge deforms at a micro-scale level to complement the surface pattern of the imaging member, wherein the surface pattern comprises micro-grooves along the moving direction of the imaging member.

12. The image forming apparatus of claim 11, wherein each indentation or protrusion has a depth of or height of from about 0.05 to about 3 micrometers.

13. The image forming apparatus of claim 11, wherein the fraction f1 between the surface area of the imaging member comprising the protrusions and the entire surface area of the imaging member ranges from about 50 percent to about 90 percent.

14. The image forming apparatus of claim 11, wherein the fraction f2 between the surface area of the imaging member minus the surface area comprising the indentations and the entire surface area of the imaging member ranges from about 50 percent to about 90 percent.

15. The image forming apparatus of claim 11, wherein the indentations or protrusions have a regular shape selected from the group consisting of circles, rods, ovals, squares, triangles, polygons, and mixtures thereof.

16. The image forming apparatus of claim 11, wherein the surface pattern comprises a square lattice or a hexagonal lattice.

17. The image forming apparatus of claim 11, wherein the micro-groove has a depth of from about 0.1 to about 2 micrometers and a width of from about 0.1 to about 100 micrometers.

18. The image forming apparatus of claim 11, wherein the blade-type cleaner comprises a polymer material having a hardness of from about 60 to about 120 Shore A.

19. The image forming apparatus of claim 11, wherein the photosensitive layer comprises multiple layers.

20. An image forming apparatus comprising:

an imaging member further comprising a substrate, a photosensitive layer disposed over the substrate, and an overcoat layer disposed over the photosensitive layer, wherein the overcoat layer has a surface pattern comprising an array of periodically ordered indentations or protrusions and each indentation or protrusion has a depth of or height of less than 3 micrometers; wherein each indentation or protrusion has a diameter in a range of from about 30 microns up to about 50 microns; and further wherein the overcoat layer comprises a crosslinked composition of a tertiary arylamine charge transport component having a general formula of

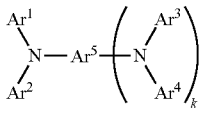

wherein $Ar^1$, $Ar^2$, $Ar^3$, and $Ar^4$ each independently represents an aryl group having about 6 to about 30 carbon atoms, $Ar^5$ represents aromatic hydrocarbon group having about 6to about 30 carbon atoms, and k represents 0 or 1, and wherein at least one of $Ar^1Ar^2$, $Ar^3$ $Ar^4$ , and $Ar^5$ comprises a substituent selected from the group consisting of hydroxyl (—OH), a hydroxymethyl (—$CH_2OH$), an alkoxymethyl (—$CH_2OR$, wherein R is an alkyl having 1 to about 10 carbons), a hydroxylalkyl having 1 to about 10 carbons, and mixtures thereof;

a charging unit that applies electrostatic charge on the imaging member;

a developing unit that develops toner image onto the imaging member;

a transfer unit that transfers the toner image from the imaging member to a media; and a cleaning unit that cleans the imaging member, wherein the cleaning unit comprises an elastic cleaning blade with one of its edge in contact with the imaging member, such that the contact edge deforms at a micro-scale level to complement the surface pattern of the imaging member.

21. The image forming apparatus of claim 20, wherein the crosslinked composition further comprises a melamine-formaldehyde resin.

22. The image forming apparatus of claim 20, wherein the crosslinked composition has an average modulus raging from about 3 to about 5 GPa as measured by nano-indentation method.

* * * * *